United States Patent [19]

Forte et al.

[11] Patent Number: 4,968,007

[45] Date of Patent: Nov. 6, 1990

[54] ANTI-SLAG, ANTI-VORTEX TUNDISH MEASUREMENT APPARATUS

[75] Inventors: Gary L. Forte, Northville; James P. McGuire, Taylor; Wayne Miller, Gibraltar, all of Mich.

[73] Assignee: AJF, Inc., Plymouth, Mich.

[21] Appl. No.: 415,596

[22] Filed: Oct. 2, 1989

[51] Int. Cl.[5] ..... C21B 7/24; C21B 7/14

[52] U.S. Cl. ..... 266/100; 266/230; 266/272

[58] Field of Search ..... 266/45, 100, 95, 227, 266/230, 272; 73/322, 323, 322.5, 309

[56] References Cited

U.S. PATENT DOCUMENTS

| | | | |
|---|---|---|---|
| 11,676 | 9/1984 | Morris | 73/323 |
| 3,691,839 | 9/1972 | Lasher | 73/323 |
| 4,553,743 | 11/1985 | LaBate, II et al. | 266/272 |
| 4,601,415 | 7/1986 | Koffron | 222/597 |
| 4,610,436 | 9/1986 | LeBate, II et al. | 266/272 |
| 4,637,592 | 1/1987 | LeBate, II et al. | 266/272 |
| 4,640,498 | 2/1987 | LeBate et al. | 266/272 |

*Primary Examiner*—S. Kastler

*Attorney, Agent, or Firm*—Basile and Hanlon

[57] ABSTRACT

An anti-slag, anti-vortex tundish measurement apparatus for use in tundishes or other molten metal receptacles provides a measurement of the depth of the molten metal layer above the bottom of such receptacles. The apparatus includes a body mounted on a first end of an elongated rod. The body and the rod are formed of a suitable material and have a predetermined size such that the specific gravity of the body and the rod is less than the specific gravity of the molten metal in the receptacle; but greater than the specific gravity of the slag layer covering the top of the molten metal layer such that the body is buoyantly supported at the interface between the slag layer and the molten metal layer. Measurement indicia in the form of incrementally spaced, scale gradations is formed on the second end of the rod, which end extends externally from the interior of the molten metal receptacle. A cover mounted on the molten metal receptacle slidably receives the second end of the rod therethrough such that the measurement indicia on the rod is disposed externally from the molten metal receptacle.

12 Claims, 1 Drawing Sheet

ANTI-SLAG, ANTI-VORTEX TUNDISH MEASUREMENT APPARATUS

BACKGROUND OF THE INVENTION

1. Field of the Invention

The present invention relates, in general, to metal making apparatus and processes and, more specifically, to metal making apparatus and processes utilizing a tundish as an intermediate receptacle to transfer molten metal from a ladle to a continuous metal casting machine.

2. Description of Relevant Art

In metal making processes, such as steel making, molten metal is transferred from a furnace via a ladle to a casting machine. When a continuous casting machine, such as a continuous slab caster, is employed, a sufficient quantity of molten metal must be maintained to supply the continuously operating slab caster. Receptacles known as "tundishes" are employed to receive molten metal from one or more ladles. A discharge nozzle is formed in the bottom wall of the tundish opening to the continuous slab caster. In this way, a sufficient quantity of molten metal is maintained within the tundish to supply a continuous stream of molten metal to the continuous slab caster.

However, in all metal making processes and, in particular, steel making processes, a layer of slag containing metal impurities forms above the top surface of the molten metal within the ladle and the tundish. When the molten metal is discharged from the tundish, it is necessary to maintain a separation between the slag and the molten metal so that high quality steel without significant amounts of slag may be produced.

Since the slag forms a layer of impurities several inches thick on top of the layer of molten metal in the tundish, slag may be introduced to the continuous slab caster through the discharge nozzle of the tundish when the level of molten metal drops below a predetermined level. When this critical level of molten metal is reached, slag is introduced directly through the discharge nozzle of the tundish into the casting machine.

In addition, the flow of molten metal through the discharge nozzle in the tundish creates a vortex which introduces a conically-shaped rotation to the molten metal within the tundish immediately above the discharge nozzle. When a sufficient quantity of molten metal is maintained within the tundish, the vortex forms completely within the molten metal layer and does not reach to the slag layer atop the molten metal layer. However, when the level of molten metal within the tundish is below the predetermined critical depth, the vortex reaches into the slag layer and draws slag through the center of the vortex to the discharge nozzle along with the molten metal. This causes the introduction of slag into the molten metal in the caster and results in steel having less than desirable qualities.

Thus, in order to prevent the production of steel having less than desirable qualities, such as that caused by the introduction of significant amounts of slag into the steel, it is necessary that the level of molten metal in the bottom of the tundish be maintained above the predetermined critical level. This requires measurement of the depth of the molten metal layer in the tundish. Previously, measurement sticks had been inserted through an access hole in the cover of the tundish to the bottom of the tundish. When the measuring stick is withdrawn, the depth of the molten metal layer may be easily determined. However, measurement of the depth of the molten metal layer must be repeated on a nearly continuous basis since molten metal is constantly being supplied to the tundish by ladles and continuously discharged through the discharge nozzle of the tundish to the continuous caster. This technique is therefore subject to considerable error and there is always a high possibility of the formation of steel having less than desired qualities if the level of molten metal inadvertently drops below the predetermined critical level.

Various apparatus have also been devised to inhibit or minimize the vortex formed above the discharge nozzle of the tundish to prevent the mixing of slag and molten metal at the discharge nozzle site. U.S. Pat. No. 4,601,415 discloses a buoyant polygonal body having a weighted apex. The body floats at the molten metal/slag interface and is held above the discharge nozzle in the vortex. The body due to its mass inhibits the formation of the vortex and minimizes the overall size of the vortex to prevent mixing of the slag with the molten metal. However, while this device minimizes or inhibits the formation of the vortex above the discharge nozzle in the tundish, it does not provide any type of measurement of the level of molten metal at the bottom of the tundish.

Thus, it would be desirable to provide an apparatus for measuring the depth of the molten metal layer in the bottom of a tundish or other molten metal receptacle which overcomes the problems of previous measurement apparatus. It would also be desirable to provide such a measurement apparatus which is inexpensive in cost and, at the same time, easy to use. It would also be desirable to provide such a measurement apparatus which provides an indication of the depth of the molten metal layer in the bottom of a tundish or other molten metal receptacle which does not require access by an operator to the interior of the tundish or molten metal receptacle.

SUMMARY OF THE INVENTION

The present invention is an anti-slag anti-vortex measuring apparatus for molten metal receptacles, such as tundishes, which contain a layer of slag over a bottommost layer of molten metal.

The apparatus comprises a body mounted on a first end of an elongated rod. The opposite, second end of the rod extends externally from the molten metal receptacle or tundish. The body and rod have a specific gravity less than the specific gravity of the molten metal in the receptacle and greater than the specific gravity of the slag layer covering the top surface of the molten metal layer so as to be buoyantly supported at the interface of the slag layer and the molten metal layer.

Measurement indicia are formed on the second end of the rod to indicate the height of the body above the discharge nozzle of the tundish or reservoir. The measurement indicia is preferably in the form of an incrementally spaced scale gradations, such as gradations in inches.

In a preferred embodiment, the body has a generally spherical shape. The overall size of the body is selected to fit within and close off the discharge nozzle at the bottom of the tundish in the event the molten metal layer falls below a predetermined critical depth. The body is preferably formed of a refractory material. The rod may be formed of a similar refractory material. However, in a preferred embodiment, the rod is formed of steel and a lowermost portion of the rod extending from the body is covered with a layer of a refractory material suitable for use in molten metals.

A cover means is mounted in the access hole in the cover of the tundish. The cover means has a through bore which slidable receives the rod of the measurement apparatus, with the second end of the rod containing the measurement indicia extending externally from the cover means. The cover means assists in centering the body and rod above the discharge nozzle of the tundish. The exact position of the body, i.e., its height above the bottom of the tundish, can be easily read from the measurement indicia on the second end of the rod which extends externally from the tundish.

The cover means also aids in centering the body in the vortex above the discharge nozzle. However, the presence of the body in the vortex acts as an inhibitor to minimize the overall shape and size of the vortex to prevent undesirable mixing of slag with the molten metal when the level of the molten metal layer is below a predetermined critical depth. Further prevention of mixing of slag with the molten metal is achieved by the use of the body which blocks the discharge nozzle when the level of molten metal drops below the predetermined critical level.

The measurement apparatus of the present invention is inexpensive in manufacturing cost and easy to use. Since the rod extends through a cover removably mounted on the top of the tundish, the rod may be in place and used to indicate the height of the molten metal layer without requiring the operator to open the cover of the tundish and probe into the interior of the tundish as with previously devised tundish measuring apparatus. The apparatus of the present invention also prevents the mixing of slag with the molten metal layer in the vortex above the discharge nozzle of the tundish since the body of the apparatus is positioned above the discharge nozzle to inhibit the formation and/or size of the vortex.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
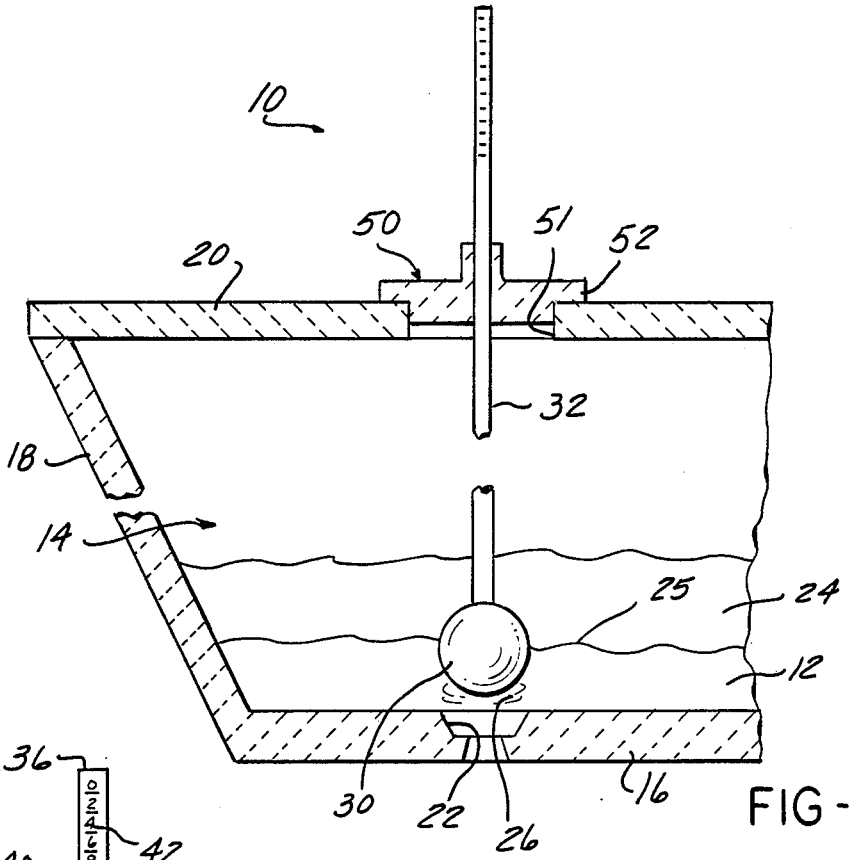
FIG. 1 is a partial, cross-sectional view showing the use of the measurement apparatus of the present invention in a tundish.

Throughout the following description and drawing, an identical reference number is used to refer to the same component shown in multiple figures of the drawing.

Referring now to FIG. 1, there is depicted an antislag, anti-vortex tundish measurement apparatus 10 which provides a measurement of the depth of a molten metal layer 12 above the bottom wall of a molten metal receptacle, such as a tundish 14.

As is well known, molten metal receptacles or tundishes 14 are employed to maintain a sufficient supply of molten metal for discharge to a continuous casting machine, not shown. Such tundishes 14 include a bottom wall 16, side walls 18 and a top cover 20. Inlets, not shown, are provided in the cover 20 to enable molten metal, such as steel, from ladles to be supplied to the interior of the tundish 14. A discharge nozzle 22 is formed in the bottom wall 16 of the tundish 14 and is positioned immediately above a metal casting machine, not shown.

As is well known, a slag layer 24 formed of metal impurities forms above the molten metal layer 12 in the bottom of the tundish 14. In order to obtain the high quality of the steel, it is necessary that slag be prevented from mixing with the molten layer 12 or introduced through the discharge nozzle 22 to the casting machine. Such introduction of slag occurs when the depth of the molten metal layer 12 falls below a predetermined critical depth such that the slag immediately flows through the discharge nozzle 22 into the casting machine. Slag may also be introduced into the casting machine by mixing with the molten metal in a vortex 26 formed above the discharge nozzle 22. Such vortexes 26 are formed by the rotary motion of the molten metal as it flows through the discharge nozzle 22. If the depth of the molten metal layer 12 is small or if the vortex 26 is large, slag may be drawn from the slag layer 24 into the vortex 26 and therefrom through the discharge nozzle 22 into the casting machine.

Figure 2:
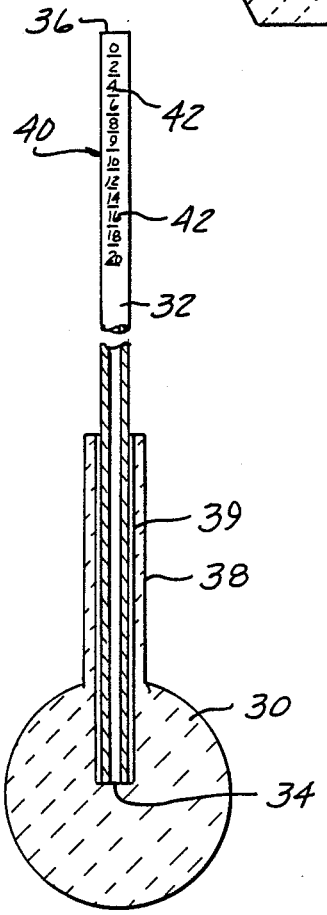
FIG. 2 is a partially sectioned, elevational view of the measurement apparatus of the present invention.
Figure 3:
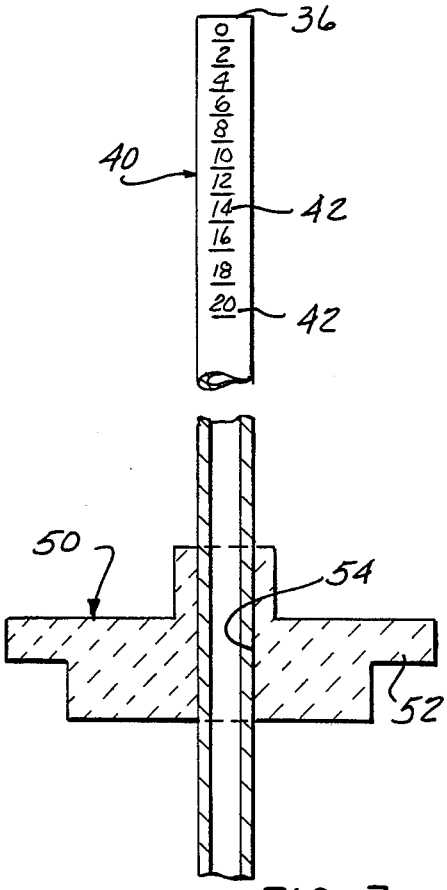
FIG. 3 is an enlarged, partial, cross-sectional view showing the mounting of the measurement apparatus of the present invention in a cover mounted on the top cover of the tundish shown in FIG. 1.

The measurement apparatus 10 of the present invention overcomes these problems and, at the same time, provides an immediate indication of the depth of the molten metal layer 12 in the tundish 14. As shown in FIGS. 1, 2 and 3, the measurement apparatus 10 comprises a body member 30 and an elongated rod 32.

The body member 30, by way of a preferred embodiment, is illustrated as having a generally spherical shape. However, it will be understood that other shapes may also be employed for the body member 30.

The overall size of the body 30 is selected such that at least a portion of the body 30 slidably fits within and closes off the discharge nozzle 22 in the bottom wall 16 of the tundish 14 if the depth of the molten metal layer 12 falls below a critical depth. This will prevent the flow of slag from the slag layer 24 through the discharge nozzle 22 into the casting machine. In a preferred embodiment, the body 30 is in the form of a ball having a diameter of approximately 6 inches.

The rod 32 is preferably a hollow tubular member having a first end 34 and a second end 36. The length of the rod 32 is selected such that the second end 36 is disposed externally of the top 20 of the tundish 14, as shown in FIG. 1. A rod 32 having a length of approximately 6 feet is employed in a preferred embodiment of the present invention.

The rod 32 may be formed of a refractory material. However, for strength, the rod 32 is formed of steel.

As shown in FIG. 2, the first end 34 of the rod 32 is joined to the body 30. In a preferred embodiment, the first end 34 of the rod 32 is disposed within the body 30 and the body cast or otherwise formed from a refractory material about the first end 34 of the rod 32. A layer 38 of a refractory material is formed externally about a cardboard tube 39 concentrically disposed about the rod 32 extending from the first end 34 for a predetermined length along the rod 32, such as three feet. The tube 39 acts as an insulator for the steel rod 32.

It is important that the weight and density of the body 30 and rod 32 which is dependant upon the materials employed in their construction and the size of the body 30 and the rod 32 have a specific gravity less than the specific gravity of the molten metal introduced into the tundish 14 and greater than the specific gravity of the slag layer 24 which forms above the molten metal layer 12 in the bottom of the tundish 14. This specific gravity may be varied by choice of materials and size depending upon the density of the molten metal introduced into the tundish 14.

This specific gravity relationship causes the body 30 to be buoyantly supported at the interface of the molten metal layer 12 and the slag layer 24 as shown in FIG. 1. Approximately one half of the body member 30 is disposed within the molten metal layer 12, with the remainder of the body 30 being disposed within the slag layer 24.

Measurement indicia denoted in general by reference number 40 is formed on the rod 32 adjacent the second end 36 of the rod 32, as shown in FIGS. 2 and 3. The measurement indicia 40 is preferably in the form of incrementally spaced, scale gradations 42. Any suitable scale, such as English or metric, may be employed. In a preferred embodiment, the scale gradations 42 are spaced at two-inch increments over a length of 20 inches extending downward from the second end 36 of the rod 32.

As the second end 36 of the rod 32 is disposed externally of the top 20 of the tundish 14, the measurement indicia 40 is exposed to view to enable an operator to easily determine the height of the body member 30 above the bottom 16 of the tundish 14 as well as the depth of the molten metal layer 12 in the tundish 14.

Cover means denoted in general by reference number 50 is employed with the measurement apparatus 10 and is removably insertable into an access or sight hole 51 formed in the top cover 20 of the tundish 14. The cover means 50 is in the form of an annular member having an outwardly extending, annular flange 52 which seats on the top cover 20 of the tundish 14 to position the cover means 50 within the sight hole 51.

The cover means 50 serves as a means for centering the body 30 and the rod 32 over the discharge nozzle 22 of the tundish 14. A through bore 54 is formed in the cover means 50 and slidably receives the second end 36 of the rod 32 therethrough, as shown more clearly in FIG. 3. In this manner, the operator may easily determine the height of the molten metal layer 12 without opening the top of the tundish 14.

In use, the second end 36 of the rod 32 is inserted through the bore 54 in the cover 50 and the cover 50 mounted in the sight hole 51 in the top cover 20 of the tundish 14. The body member 30 will be buoyantly supported at interface 25 of the molten metal layer 12 and the slag layer 24. The amount of extension of the rod 32 above the cover 50 provides an indication via the measurement indicia 40 of the depth of the molten metal layer 12. The operator can thus easily determine when the molten metal layer 12 falls below a predetermined critical depth requiring the shutting down of the continuous slab casting machine or other corrective action. At this time, the body 30 slidably fits within the discharge nozzle 22 in the tundish 14 closing off the flow of molten metal 12 through the discharge nozzle 22.

In summary, there has been disclosed a unique anti-slag, anti-vortex measuring apparatus which provides an indication of the depth of a molten metal layer in a molten metal receptacle or tundish. The apparatus of the present invention is simple to use and may be inexpensively constructed so as to enable its discarding after a single use. The measurement apparatus may be constructed of different materials and in different sizes so as to vary its overall density and enable its use with different molten metals having varying densities.

What is claimed is:

1. A combination of an anti-slag, anti-vortex measurement apparatus and a molten metal receptacle in which a layer of slag covers a layer of molten metal the combination comprising:

the receptacle having a discharge nozzle disposed below the layer of molten metal and a sight aperture disposed above the slag layer; and a measurement apparatus comprising:

a body;

an elongated rod having first and second ends, the first end of the rod being connected to the body, the second end of the rod extending externally from the molten metal receptacle through the sight aperture;

the body and the rod having a specific gravity less than the specific gravity of the molten metal in the receptacle and greater than the specific gravity of the slag layer covering the layer of molten metal so that the body is buoyantly supported at the interface of the slag layer and the molten metal layer; and measurement indicia means formed on the rod and spaced from the first end of the rod for indicating the height of the body and thereby the depth of the molten metal layer above the discharge nozzle of the molten metal receptacle externally from the molten metal receptacle.

2. The combination of claim 1 wherein the body is a spherical ball.

3. The combination of claim 1 wherein:

the body and at least a portion of the rod extending from the first end of the rod have an external layer of a refractory material formed thereon.

4. The combination of claim 1 wherein:

the rod is formed of steel, the first end of the rod extending partially into the body;

the body being formed of a refractory material; and a layer of a refractory material disposed on the rod extending from the body for a predetermined length along the rod.

5. The combination of claim 1 further including:

means for centering the body and the rod over the discharge nozzle in the molten metal receptacle.

6. The combination of claim 5 wherein the centering means comprises:

a cover removably mountable in the sight aperture of the molten metal receptacle;

the cover having a through bore extending therethrough slidably receiving the rod such that the second end of the rod movably extends externally through the cover and the measurement indicia means on the rod is viewable externally of the cover.

7. The combination of claim 1 wherein:

the measurement indicia means includes a plurality of incrementally spaced, scale gradations disposed on the rod.

8. The combination of claim 1 further including:

means for supporting the body and the rod through the sight aperture in the molten metal receptacle.

9. The combination of claim 8 wherein the supporting means comprises:

a cover removably mountable in the sight aperture of the molten metal receptacle;

the cover having a through bore extending therethrough slidably receiving the rod such that the second end of the rod movably extends externally through the cover and the measurement indicia means on the rod is viewable externally of the cover.

10. In a molten metal receptacle wherein a layer of slag covers a layer of molten metal and the receptacle has a discharge nozzle beneath the layer of molten metal and a sight aperture disposed above the slag layer, the improvement comprising:

a measurement apparatus, the measurement apparatus including:

a body;

an elongated rod having first and second ends, the first end of the rod being connected to the body, the second end of the rod extending externally from the molten metal receptacle through the sight aperture;

the body and the rod having a specific gravity less than the specific gravity of the molten metal in the receptacle and greater than the specific gravity of the slag layer covering the layer of molten metal so that the body is buoyantly supported at the interface of the slag layer and the molten metal layer; and measurement indicia means formed on the rod and spaced from the first end of the rod for indicating the height of the body and thereby the depth of the molten metal layer above the discharge nozzle of the molten metal receptacle, the measurement indicia means extending externally from the molten metal receptacle through the sight aperture.

11. The improvement of claim 10 wherein:

the measurement indicia means includes a plurality of incrementally spaced, scale gradations disposed on the rod.

12. The improvement of claim 10 further including:

means for supporting the body and the rod through the sight aperture in the molten metal receptacle.

* * * * *